US005509814A

United States Patent [19]

Mosquera

[11] Patent Number: 5,509,814

[45] Date of Patent: Apr. 23, 1996

[54] SOCKET CONTACT FOR MOUNTING IN A HOLE OF A DEVICE

[75] Inventor: Rene A. Mosquera, Laguna Niquel, Calif.

[73] Assignee: ITT Corporation, New York, N.Y.

[21] Appl. No.: 69,493

[22] Filed: Jun. 1, 1993

[51] Int. Cl.[6] ..... H01R 9/09

[52] U.S. Cl. ..... 439/82; 439/78

[58] Field of Search ..... 439/78–83, 851–857, 439/885

[56] References Cited

U.S. PATENT DOCUMENTS

| | | | |
|---|---|---|---|
| 2,877,441 | 3/1959 | Narozny | 439/82 |
| 3,504,328 | 3/1970 | Olsson | 359/17 |
| 3,601,786 | 8/1971 | Brubaker | 339/258 |
| 3,654,583 | 4/1972 | Mancini | 339/17 |
| 3,777,303 | 12/1973 | McDonough | 339/258 |
| 3,792,412 | 2/1974 | Madden | 439/82 |
| 3,858,153 | 12/1974 | Coller et al. | 439/82 |
| 3,902,153 | 8/1975 | Narozny | 339/214 |
| 4,097,101 | 6/1978 | Holt et al. | 339/17 |
| 4,175,810 | 11/1979 | Holt et al. | 339/17 |
| 4,585,295 | 4/1986 | Ackerman | 339/258 |
| 4,657,336 | 4/1987 | Johnson et al. | 339/258 |
| 4,728,304 | 3/1988 | Fischer | 439/842 |
| 4,752,250 | 6/1988 | Seidler | 439/751 |
| 4,784,622 | 11/1988 | Senor | 439/853 |
| 4,784,623 | 11/1988 | Beck, Jr. | 439/872 |
| 4,867,691 | 9/1989 | Eck | 439/853 |
| 4,894,031 | 1/1990 | Damon et al. | 439/885 |
| 4,934,967 | 6/1990 | Marks et al. | 439/856 |
| 4,952,178 | 8/1990 | Beer | 439/856 |
| 5,066,237 | 11/1991 | Shiley | 439/82 |
| 5,071,375 | 12/1991 | Savage Jr. | 439/853 |
| 5,083,927 | 1/1992 | Herard et al. | 439/80 |
| 5,135,403 | 8/1992 | Rinaldi | 439/82 |
| 5,154,621 | 10/1992 | Legrady | 439/82 |

*Primary Examiner*—David L. Pirlot
*Attorney, Agent, or Firm*—Freilich Hornbaker Rosen

[57] ABSTRACT

A miniature socket contact (10, FIG. 1) is described which fits within the thickness of a device such as PC board plated hole (20), which is firmly retained within the hole, without damage to the hole plating during removal, and wherein each pin-contacting beam (70, 72) has two points of contact with an inserted contact pin (14). The contact is formed of sheet metal and has an upper retention portion (30) forming retention tabs (42–46), with each tab having an inner part (50) extending radially inwardly, an outer part (56) extending radially outwardly with a tip (60) that presses against the hole walls, and a bent middle (54) that guides an inserted pin and is preferably deflected outwardly by the inserted pin to press the tab tip firmly against the hole walls. The contact has a lower contacting portion (32) forming a pair of downwardly converging beams (70, 72) whose lower ends engage the inserted pin. As seen in a view (FIG. 6) along the contact axis, the inner edge (**74*e*, 76*e*) of each beam lower end has a sharply curved middle (110) spaced from the pin (14) and opposite sides that each have a pin-engaging location ( 116, 118**).

9 Claims, 2 Drawing Sheets

FIG. 6
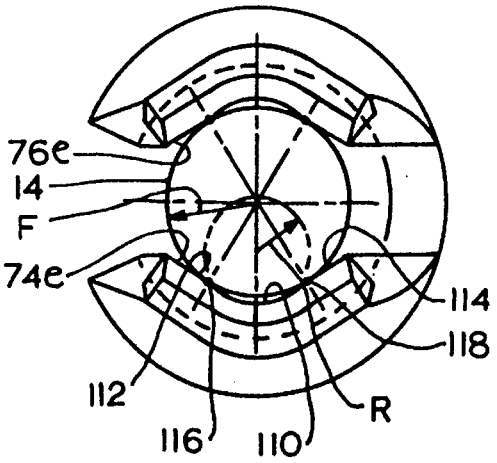
FIG. 7
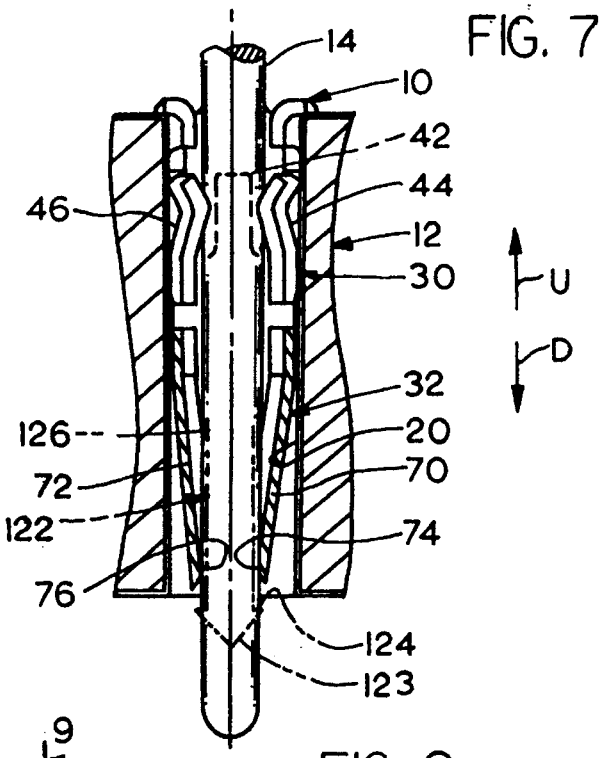
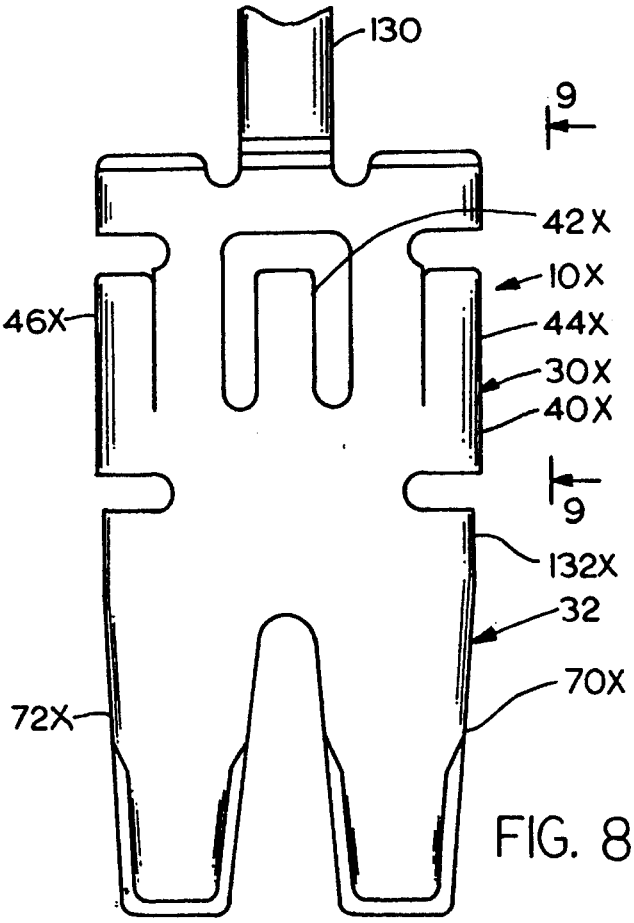
FIG. 8
FIG. 9
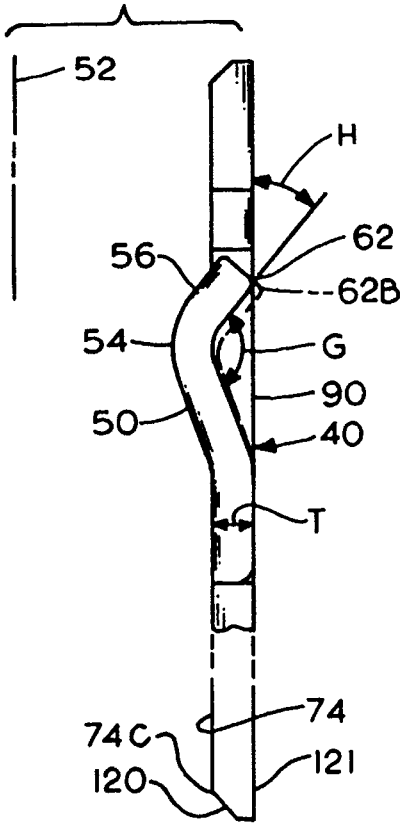

SOCKET CONTACT FOR MOUNTING IN A HOLE OF A DEVICE

BACKGROUND OF THE INVENTION

Circuit boards can be constructed with plated holes in which socket contacts are installed, so the contact pins of a connector can be inserted into the socket contacts to make electrical connection with conductive traces on the circuit board. The sockets often must fit within the thickness of the board (usually 0.100 inch or 2.5 mm). It is also desirable that the socket contacts remain securely in the plated holes during repeated insertion and removal of pins, and that a damaged socket contact be readily removable from the upper surface of the board which originally receives the pins. A miniature socket contact which could be easily installed in a hole of a device such as in a plated hole of a circuit board and preferably lie within the board thickness, which provided multiple engagement points between the socket contact and pin, which resisted removal of the socket contact along with a withdrawn pin, and which facilitated removal of a damaged socket contact, would be of considerable value.

SUMMARY OF THE INVENTION

In accordance with one embodiment of the present invention, a miniature socket contact is provided for installation in a hole of a device such as in a plated hole of a circuit board, which is securely retained in the hole and which provides multiple contact points with an inserted pin. An upper retention portion of the contact has tabs spaced about the axis of the contact. Each tab has an inner pad extending at a radially inward incline, an outer pad extending at a radially outward incline and having a tip for engaging the hole walls, and a bent middle connecting the pads. The middles of the tabs lie on an imaginary circle to guide a downwardly inserted pin, with the imaginary circle preferably being slightly less than the pin diameter so the pin presses out the tabs to press their tips firmly against the hole walls.

The socket contact has lower contacting portion forming beams extending downwardly and at a radially inward incline so the lower ends of the beams will engage an inserted pin. As seen in an axial view, the lower end of each beam has a sharply curved middle that is spaced from the pin, and has opposite sides that each engage the pin, to provide two contact locations for each beam. A tool for removing a contact includes a shank of a diameter preferably less than that of a pin contact, and having a head forming an upwardly-facing shoulder. The tool is inserted completely through the contact until the shoulder on the tool head lies against the lower ends of the beams, so upward force on the tool pulls the socket contact up and out of the hole.

The novel features of the invention are set forth with particularity in the appended claims. The invention will be best understood from the following description when read in conjunction with the accompanying drawings.

BRIEF DESCRIPTION OF THE DRAWINGS

FIG. 6 is a bottom view of the contact of FIG. 1, in its installed and contracted configuration.

FIG. 7 is a front view of the socket contact and board of FIG. 1, but with a contact pin installed in the socket contact.

FIG. 8 is a front elevation view of the socket contact of FIG. 1, after it has been blanked but before it has been bent.

FIG. 9 is a view taken on the line 9—9 of FIG. 8.

DESCRIPTION OF THE PREFERRED EMBODIMENT

Figure 1:
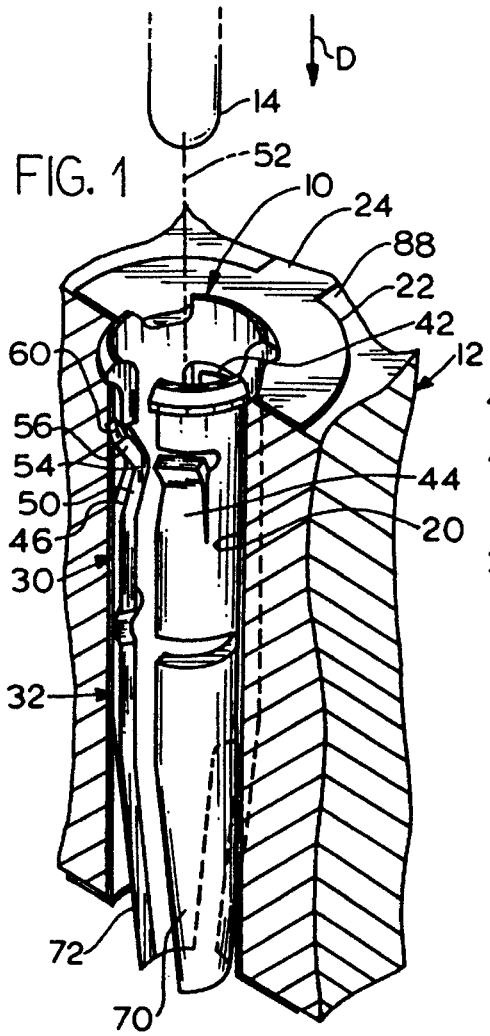
FIG. 1 is a partially sectional isometric view of a socket contact in a fully installed position in a circuit board, and showing a contact pin prior to its insertion, in accordance with the present invention.

FIG. 1 illustrates the combination of a socket contact 10, a device for receiving the socket contact which is shown as a circuit board 12 in which the socket contact is mounted, and a contact pin or pin 14 which can be inserted in a downward direction D into the socket contact. The socket contact lies in a hole of a device which is shown as a plated hole 20 of the circuit board, and has a trace 22 on its upper surface which extends through a conductor 24 to circuitry, other contacts, etc. The combination is especially useful where the circuit board hole 10 has a very small diameter such as 25 mils (1 mil equals 1 thousandth inch) or 0.6 mm, to receive a very narrow pin of a diameter such as 12 mils (0.3 mm) to enable attachment of a miniature connector with a large number of pins. The socket contact is constructed so it can be readily inserted downwardly into the board hole, is securely held in the hole to resist removal when an inserted pin is removed, and makes contact with the pin at multiple points.

Figure 2:
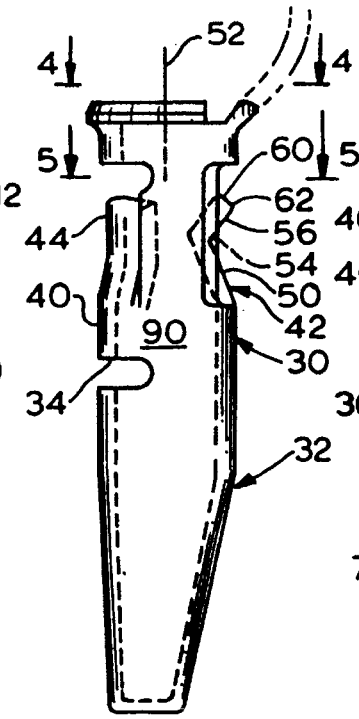
FIG. 2 is a side elevation view of the socket contact of FIG. 1, in an expanded configuration.
Figure 3:
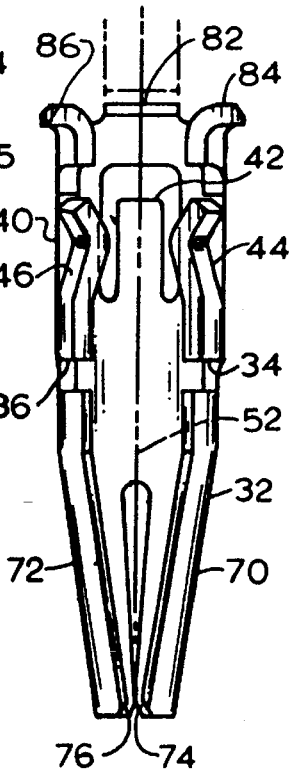
FIG. 3 is a front elevation view of the socket contact of FIG. 2.

As shown in FIGS. 2 and 3, the socket contact 10 has an upper retention portion 30 and a lower contacting portion 32, which are somewhat isolated from each other by horizontal slots 34, 36. The retention portion 30 includes an annular main part 40 which is largely in the form of a tube with a slot extending along its length, and includes three tabs 42, 44, and 46. Each tab has an inner or first part 50 extending at an incline to the socket contact axis 52 from the main part 40 of the contact. That is, the inner part 50 extends with both radially inward (towards the axis) and axial (parallel to the axis) directional components. The tab has a curved middle 54, and has an outer or second part 56 extending at a radially outward incline from the middle. The outer part has a tip 60 with a radially outer edge 62 that can press against the plated hole walls of the circuit board hole, to retain the socket contact in the hole.

The lower contact portion 32 includes a pair of beams 70, 72 which extend downwardly and at radially inward inclines. The beams have lower ends 74, 76 which are spread apart by an inserted pin, and which contact the pin.

Figure 5:
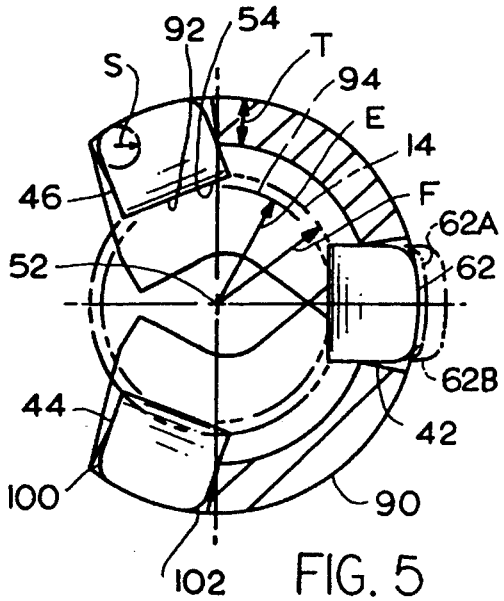
FIG. 5 is a sectional view of the contact of FIG. 2, taken on the line 5—5 thereof.

The socket contact is installed by inserting it downwardly into the circuit board hole until lips 82–86 of the socket contact bear against the upper surface 88 of the circuit board. The socket contact is formed of sheet metal which has been bent into a tubular shape about the axis 52, but with the bending radius being large enough that the contact is compressed to a reduced diameter to lie in interference fit with the hole walls. Applicant increases retention by having the outer edges 62 of the tabs press firmly against the hole walls to locally deform the plating of the hole walls. As shown in FIG. 9, this can be accomplished by forming the tabs so their outer edges at 62B extend radially beyond the outer surface 90 of the tubular, or annular, main part 40 of the upper contact portion. However, in addition or instead of such initial tab positioning, applicant can use an inserted pin to assure firm contact of the tabs with the plated hole walls. As shown in FIG. 5, center locations 92 at the middles 54 of the three tabs lie on an imaginary tab circle 94 of closely controlled diameter. The radius E of the tab circle in the board-installed socket contact, is slightly less than the radius F of the pin 14. As a result, when the pin is inserted into the contact, it spreads apart the tabs so their outer edges move from the locations 62 to the deflected locations 62A. At the deflected locations 62A, the edges press firmly against the hole walls to securely retain the socket contact in the hole. Even if the tabs initially are deflected to the position 62A, or even further to the position 62B, the tabs are likely to be initially deflected most of the distance to the position 62 by the force of the hole walls. However, the outward pressing of the tabs by the inserted pin will then press the tab edges outwardly to more firmly press against the hole walls to retain the socket contact. Even if the tabs are not pressed outwardly by the pin, the middles of the tabs serve to closely position the pin so it will lie closer to being parallel and concentric with the socket contact when reaching the beam lower ends 74, 76.

Applicant prefers to round the opposite corners 100, 102 of the tab outer edge. This avoids a sharp edge which might penetrate the plating, especially if a tab is tilted slightly when pressed radially outwardly. FIG. 5 shows each of the corners curved about a radius of curvature S, which is preferably greater than 10% of the tab thickness T, and more preferably greater than 20% of the tab thickness. Applicant also rounds the edge 62 as seen in a side view as in FIG. 9. Applicant constructs each tab so there is an obtuse angle G such as 120° between the inner and outer pads 50, 56 of the tab. The outer part 56 extends at an angle H of about 40° with the axis, or 50° away from a radial direction. This facilitates straightening of the tab so it does not press too forcefully against the plated hole walls.

FIG. 7 shows the pin 14 fully installed in the socket contact 10 while the contact lies in the plated hole 20 of the circuit board 12. The lower ends 74, 76 of the beams are engaging the pin. The pin is shown as being long enough to project completely through the circuit board so it can engage a contact in another, lower, circuit board.

FIG. 6 shows the shape of the radially inner edge surfaces or edges 74*e*, 76*e* of the beam lower ends or tip regions. Each beam lower edge has a middle 110 which is concavely curved about a radius R which is less than the radius F of the pin, and preferably less than 80% of the pin radius. The edge also has opposite ends 112, 114 that each have a radius of curvature greater than the radius F of the pin, the particular ends illustrated being straight (so they have an infinite radius of curvature). This construction results in the middle 110 being spaced from the pin, but the opposite ends contacting the pin at the locations 116, 118. As a result, each beam contacts the pin at two locations. This has the advantage of providing four contact points for the two beams. An increased number of contact points decreases the possibility of poor contact. The provision of two contact points for each beam also has the advantage of aligning the lower end of each beam with the pin. This can avoid the need to provide three beams, which can be difficult in a miniature socket contact. As shown in FIG. 9, applicant prefers to form a rounding or bevel at 120 immediately below each contact edge such as 74*e*, to provide a taper to avoid damage to the beam when the pin is pulled out of the socket contact. The bevel 120 is at an angle of 45° with the socket contact axis, with the angle preferably being at least about 30° . The outer surface 121 is straight.

The socket contact can be readily removed, as indicated in FIG. 7, by installing a removal tool, shown in phantom lines at 122, in place of the pin 14. The removal tool has a head 123 at its lower end which forms a shoulder 124 that faces in an upward direction U. After the tool is installed as shown, with the shoulder 124 below the lower ends 74, 76 of the beams, the tool is pulled upwardly to pull up the socket contact out of the circuit board. The removal tool has a shank 126 which is preferably of smaller outside diameter than the pin 14, so that the shank does not press the retention tabs 42–46 radially outwardly against the walls of the plated hole 20.

Figure 4:
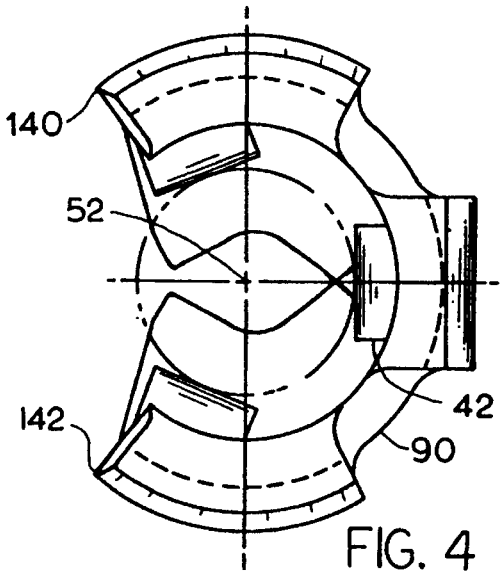
FIG. 4 is a plan view of the socket contact of FIG. 2, taken on the line 4—4 thereof.

FIG. 8 shows a socket contact preform 10X with the metal completely formed but in a primarily flat configuration, and with the socket contact preform attached to a carrier 130 which will hold numerous other similar preforms. The preform 10X is formed by bending the tabs 42x–46x and the beams 70X, 72X to the relative configurations illustrated in the other figures. Then the rest of the preform, primarily the main part 40X of the upper retention portion 30X and the main part 132X of the lower contacting portion 32 are bent to extend about 260° around the axis of a 360° circle, as shown in FIG. 4. The ends 140, 142 of the circle are then compressed closer together as the socket contact is pressed downwardly into the plated hole of the circuit board, where the preform is compressed to extend about 310° around the axis.

Applicant has designed socket contacts of the type illustrated, of beryllium copper sheet metal having a thickness T (FIG. 9) of 3.5 mil (0.0035 inch, or 0.09 mm). The socket contact is designed to fit in a plated hole having a diameter between 22 and 26 mil (0.56 mm and 0.66 mm). The socket contact was designed to receive a pin having an outside diameter of 12 mil (0.31 mm). The tab circle 94 (FIG. 5) oil which lay the middles 92 of the tabs of the installed socket contact, was designed to equal 13 mil in the average case (hole diameter of 24 mil or 0.61 mm). Each tab corner 100, 102 was coined to a radius S of 1 mil (0.02 mm). The radially outer edge 62 (FIG. 9) of each tab was rounded to a radius of about 0.5 mil (0.01 mm). The removal tool 120 (FIG. 7) had a shank 126 of a diameter of 10 mil (0.25 mm) with its head shoulder 124 having an outside diameter of 13 mil (0.33 mm).

While terms such as "upper", "lower", "up", "down", etc. have been used herein to describe the relative positions and direction shown in the drawings, such descriptions only relate to the relative positions of parts rather than their orientation with respect to gravity, since the parts can be used in orientation with respect to gravity.

Thus the invention provides a socket contact which can be fully installed within a device such as a circuit board (except for lips at the top of the contact) and which can receive a pin, which provides secure retention of the socket contact in the board and reliable electrical engagement between the contact and pin. The socket contact has an upper retention portion forming a plurality of tabs. Each tab has an inner part extending at a radially inward incline, an outer part extending at a radially outer incline, and a middle between them. The middles of the tabs serve to guide an inserted pin to keep it centered and aligned with the socket contact, and especially with beams at the lower part of the contact. The middles of the tabs can lie on an imaginary circle which is usually less than the diameter of the inserted pin, so the pin deflects the tabs outwardly to press them firmly against the walls of the circuit board hole. The lower contacting portion includes a plurality of beams, usually two beams, which have lower ends for engaging the pin. The lower end of each beam has a middle, as seen in an axial view, which is curved to a small radius of curvature to lie spaced from the pin, and has opposite sides of a larger radius of curvature than the pin. This results in each beam providing two points of contact with the pin and helps keep the pin and beam aligned.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. A socket contact for receiving a downwardly-inserted pin of substantially cylindrical shape and of predetermined radius, wherein the contact has a vertical axis and upper and lower portions spaced along said axis, and wherein said lower portion includes a plurality of beams having upper ends integral with said upper portion and free lower ends, with said beams extending largely downwardly and with a radially inward directional component from said upper ends to said free lower ends, characterized by;

at least one of said beam free ends has a pin-contacting radially inner surface that includes middle and opposite sides, wherein, as seen in a view along said axis, said middle has a radius of curvature less than said pin radius, and said opposite sides have pin-contacting locations each of a larger radius of curvature than said pin radius.

2. The socket contact described in claim 1 wherein: the radius of curvature of said middle is less than 80% of said pin radius.

3. The socket contact described in claim 1 wherein:

said contact is formed of sheet metal, said beams have lower portions that each extends at a radially inward-downward incline, and said beam free ends each have a tip region with the radially outer surface of the tip region extending in substantially a straight line and with the radially inner surface of the tip region being tapered so the tip region is of progressively smaller thickness at progressively lower locations therealong.

4. A socket contact for installation in a hole that has hole walls, of a device, to receive a pin of predetermined pin radius, wherein the contact is formed of sheet metal and has a retention portion with an axis, said retention portion having a plurality of retention tabs, characterized by:

each of said retention tabs has an inner part extending with a radially inward directional component, an outer part extending with a radially outward directional component to engage said hole walls, and a middle lying between said inner portion and said outer portion and having a location lying closer to said axis than either said inner or outer tab parts to closely guide said pin during its insertion;

said tab outer parts each extend at an incline to said axis and have a free end with a tip, each tip having a radially outer edge for pressing into said hole walls, said tab having opposite sides and said tip forming a corner at the intersection of each tip edge and the tab side, with each corner being rounded at a radius of curvature greater than 10% of the tab thickness to avoid scraping said hole walls.

5. A socket contact for installation in a hole that has hole walls, of a device, to receive a pin of predetermined pin radius, wherein the contact is formed of sheet metal and has a retention portion with an axis, said retention portion having a plurality of retention tabs, characterized by:

each of said retention tabs has an inner part extending with a radially inward directional component, an outer part extending with a radially outward directional component to engage said hole walls, and a middle lying between said inner portion and said outer portion and having a location lying closer to said axis than either said inner or outer tab parts to closely guide said pin during its insertion;

said tab outer parts each extend at an incline to said axis and have a free end with a tip, each free end and the tip thereof being inclined from said axis and positioned to press into said hole walls.

6. A socket contact for installation in a hole with hole walls, of a device, to receive a pin of predetermined pin radius, wherein the contact is formed of sheet metal and has a retention portion with an axis, said retention portion having a plurality of retention tabs, characterized by:

each of said retention tabs has an inner part extending with a radially inward directional component, an outer part extending with a radially outward directional component to engage said hole walls, and a middle lying between said inner part and said outer part and having a location lying closer to said axis than either said inner or outer tab parts to closely guide said pin during its insertion, with substantially the entire length of said middle being curved to form a transition between said inner and outer parts with a convexly curved inner surface.

7. The socket contact described in claim 6 wherein:

said pin is of circular cross-section, and said socket contact has three retention tabs spaced about said axis to largely center said pin within said hole.

8. The socket contact described in claim 6 wherein:

said socket contact is designed to receive said pin by movement of said pin in a predetermined downward direction along said axis, with said pin being of substantially circular cross-section;

said socket contact includes a contacting portion lying below said retention portion, said contacting portion including a plurality of beams extending with downward and radially inward directional components and having lower ends for engaging said pin;

said beam lower ends each being formed, as seen in an axial view, with a concavely curved middle having a radius of curvature that is less than said pin radius and with opposite ends each having a radius of curvature greater than said pin radius.

9. A combination of a device having a hole that has hole walls, a socket contact lying in said hole, and a pin of substantially circular cross-section and of a predetermined pin radius, received in said socket contact, wherein the contact has a vertical axis and is formed of sheet metal, and has an upper retention portion and a lower contacting portion, characterized by:

said lower portion includes a plurality of downwardly and radially inwardly extending beams with lower ends spaced about said axis and contacting said pin;

said retention portion includes an annular main part which tends to expand to engage said hole walls and includes a plurality of tabs each having a first end merging with said main part and extending at a radially inward incline from said axis, a second end extending at a radially outward incline from said axis and engaging said hole walls when said pin is received in said socket contact, and a bent middle connecting said ends;

said annular main part at said first ends of said tabs, being of sufficient outside diameter that it presses against said hole walls before said pin is received in said socket contact, to thereby minimize the required deflection of said tabs.

* * * * *